US005177823A

United States Patent [19]

Riach

[11] Patent Number: 5,177,823

[45] Date of Patent: Jan. 12, 1993

[54] ADJUSTABLE HEADREST

[75] Inventor: Jeffrey M. Riach, Parkton, Md.

[73] Assignee: Oakworks, Inc., Glen Rock, Pa.

[21] Appl. No.: 882,497

[22] Filed: May 13, 1992

[51] Int. Cl.[5] ..... A61G 7/06; A47C 20/04

[52] U.S. Cl. ..... 5/636; 5/622; 5/638; 5/140; 5/643; 297/408

[58] Field of Search ..... 5/622, 636, 638, 640, 5/643; 297/408, 409

[56] References Cited

U.S. PATENT DOCUMENTS

| | | | |
|---|---|---|---|
| 1,009,417 | 11/1911 | John | 297/408 X |
| 1,728,025 | 9/1929 | Weber | 5/643 X |
| 2,463,410 | 3/1949 | Morris | 5/640 |
| 2,586,417 | 2/1952 | Cole | 297/409 |
| 2,661,050 | 12/1953 | Felter | 297/409 X |
| 3,114,527 | 12/1963 | Demarest | 5/638 X |
| 3,477,761 | 11/1969 | Krantz | 297/409 |
| 3,858,937 | 1/1975 | Norris | 297/408 |
| 4,139,093 | 6/1979 | Hamilton | 297/409 X |
| 4,779,297 | 10/1988 | Sturges | 5/638 X |

FOREIGN PATENT DOCUMENTS

| | | | |
|---|---|---|---|
| 2161702 | 1/1986 | United Kingdom | 297/408 |

*Primary Examiner*—Michael F. Trettel
*Attorney, Agent, or Firm*—Leonard Bloom

[57] ABSTRACT

An adjustable headrest whose height and angle may be selectively adjusted. The selected height may be adjusted by the use of a cam clamp that requires the use of only one hand to operate. The selected angle may be adjusted by the use of a cam clamp that also requires the use of only one hand to operate.

16 Claims, 7 Drawing Sheets

ADJUSTABLE HEADREST

FIELD OF THE INVENTION

The present invention relates to headrest platforms and, in particular, to headrests for use in conjunction with examination tables, exercise tables or other supports, which headrests are adjustable in both height and angle relative to the support.

BACKGROUND OF THE INVENTION

Headrests have long been provided for use in conjunction with supports as varied as medical examination and operating tables, exercise tables and sunbathing aids. They are provided for supporting the head of an individual by cradling either the back of the user's head or the user's face in such a manner as to permit the individual to breathe comfortably. Examples of such headrests can be found by reference to U.S. Pat. No. 348,655 issued to Bretherton; U.S. Pat. No. 418,004 issued to Frick; U.S. Pat. No. 2,551,727 issued to Costello; and U.S. Pat. No. Des. 249,360 issued to Lacock.

For almost as long as such headrests have been provided, the desirability for such headrest to be adjustable to best suit the particular features of the individual who is being supported thereby has also been recognized. This is done so as to support the patient's head relative to their body in the best possible position. Such a feature is especially important to position the cranial area of patients with neck injuries, so as to provide the proper skeletal and muscular relationships which such patients need.

In response to the above, many headrests have been fitted, so as to provide such adjustability. Examples of such headrests have been disclosed in the following U.S. Pat. Nos.:

| U.S. Pat. No. | Inventor(s) | Year of Issue |
|---|---|---|
| 933,471 | Leahy | 1909 |
| 1,134,720 | Bradley | 1915 |
| 1,728,025 | Weber | 1929 |
| 2,509,086 | Eaton | 1950 |
| 2,564,323 | Brown | 1951 |
| 2,684,064 | Thompson | 1954 |
| 2,861,279 | Myers | 1958 |
| 3,114,527 | Demarest | 1963 |
| 3,606,302 | Willard, et al. | |
| 3,806,110 | Glasser, et al. | 1974 |
| 4,681,370 | Vancil | 1987 |
| 4,917,363 | Evans, et al. | 1990 |

While being useful for their purposes, to make adjustments to the height and/or angle of those head-rests in order to better accommodate the patient, the disclosures noted above rely upon the use of arrangements that are either complicated, expensive, adjustable in only one orientation and/or which require the use of two hands to operate the mechanisms thereof which secure and release the headrest, so that the desired adjustments of the height and angle of the headrest relative to the support may be made. Many also offer only one, centrally positioned support for the headrest.

It is noted that if two hands are needed to operate the mechanism that secures or releases the headrest, then the user does not have any free hand to move the headrest into the desired position therefor. Accordingly, readjustments of the position of the headrest are often required. In a similar fashion, in devices where both sides of the headrest need to be secured and released individually, then readjustment of at least one of the sides of the headrest is often necessary in order to insure the proper height and angle relative to the support.

U.S. Pat. No. 2,463,410, issued to Morris, and U.S. Pat. No. 2,958,373 issued to Behrens, each provide headrest devices that provide separate pivoting joints for height and angular adjustment of the head position. However, in each of these references, the angular and height adjustments are provided by mechanical means that are complicated or expensive. Mechanisms are also employed that require the use of two hands to secure or release the headrest. For example, in Morris, the headrest is locked into position by the use of bolts and nuts that are located on both sides of the headrest. These nuts and bolts must be tightened or loosened by the use of a wrench or other similar element and require the use of two hands to perform.

It is further noted that it is desirable to provide a headrest in which both sides thereof are joined to, or otherwise supported by, the support. Such an arrangement provides the headrest with increased stability which is especially important where medical injuries and operative procedures are involved.

To the best of my knowledge, there is no headrest that is adjustable both in height and in angle relative to the table in which both sides thereof are joined to the support, and wherein both of these sides may be simultaneously secured or released with the use of only one hand, so that the other hand is free to simultaneously move and adjust the headrest to the height and angle desired. In this regard, there is no disclosure of which I am aware in which a "double-locking action"—that is, wherein both sides of the device ar simultaneously locked and released —is either disclosed or provided. Further in this regard, it is noted that none of the references provide a cam lock, or a camming action or other equivalent structure or action which can be activated and deactivated with the use of only one hand in order to permit the headrest to be moved and adjusted with the other hand.

Accordingly, it can be seen that there remains a need for a headrest whose height and angle may be selectively adjusted with the use of only one hand by the use of simple and inexpensive cam locks that exert camming actions.

SUMMARY OF THE INVENTION

It is a primary object of the present invention to provide a headrest for an examination table, therapy table and the like in which the height and the angle of the headrest relative to the table is readily adjustable and which includes cam locks that employ a camming action to simultaneously lock and release both sides of the headrest.

It is a further object of the present invention to provide such a headrest in which each cam lock provides a "double-locking" action which locks and releases both sides of the headrest.

It is a still further object of the present invention to provide such a headrest in which the arrangement employed to provide the height and angle adjustments are simple and inexpensive.

In accordance with the teachings of the present invention, an adjustable headrest for supporting the head of a user thereon is disclosed. The headrest includes a pair of parallel support rods that are carried by a support, so as to extend outwardly therefrom. A pair of pivotal coupling elements are also provided. Each of the coupling elements has a respective first end that is pivotally connected to and carried by respective support rods. In this fashion, the coupling elements vertically pivot about the support rod on which said element is carried, whereby the angle of the coupling members with respect to the support rods may be selectively adjusted. Means is formed between the first ends of the coupling elements and the support rods for selectively "double-releasing" and "double-locking" the coupling elements at any desired angle relative to the support rods. In this fashion, the angle between the user's head and the user's spine may be selectively adjusted and maintained. This means includes a first cam clamp that is associated with the first ends of the coupling elements and the support rods. This first cam clamp is provided for selectively unlocking and "double-releasing" the coupling elements so that the angle of the coupling elements relative to the support rods may be selectively adjusted. This first cam clamp is further provided for selectively "double-locking" the coupling elements at the angle selected, so that the selected angle of the coupling elements relative to the support rods may be maintained. Each coupling element further has a respective second opposite end that is pivotally connected to opposite sides of the headrest, such that the headrest is stably carried thereby, so that the headrest vertically pivots about the second ends of the coupling elements. The headrest includes a headrest frame that has opposite sides which are carried by the coupling elements for pivotal movement therewith. In this manner, the adjustment of the angle of the coupling members relative to the support rods concomitantly selectively adjusts the angle of the headrest frame with respect to the support rods. A headrest pad is carried by the headrest frame for pivotal movement therewith. In this manner, the adjustment of the angle of the coupling members relative to the support rods concomitantly selectively adjusts the angle of the headrest pad with respect to the support rods. Means is formed between at least one of the second ends of the coupling elements and the headrest frame for selectively releasing and locking the headrest frame and the headrest pad carried thereon at any desired angle relative to the support, whereby the angle between the user's head and the user's neck may be selectively adjusted. This means includes a second cam clamp that is associated with the second end of a respective coupling element for selectively unlocking the headrest at the angle selected, so that the selected angle of the headrest relative to the coupling elements may be maintained. In this manner, either cam clamp may be operated with the use of only one hand while the other hand holds and moves the headrest for selectively adjusting the angle of the headrest with respect to the support. Accordingly, a headrest is provided that is selectively adjustable for positioning the user's head at the desired angle between the user's spine and neck.

Preferably, the cam clamps employ a camming action and which may be activated and deactivated by a flick of a finger or thumb of the same hand that holds and adjustably moves the headrest. In this manner, the cam clamps may be locked and unlocked with the use of only one hand.

In a preferred embodiment, the means formed between the first ends of the coupling elements and the support rods for selectively "double-locking" and "double-releasing" the coupling elements at any desired angle relative to the support rods includes respective circular rows of mating teeth that are formed on the first ends of each of the coupling elements and the support rods, so that the rows of teeth on the first ends are opposite respective rows of teeth that are formed on the support rods. In this fashion, when the opposite rows of locking teeth are bought into engagement (contact) with one another, the coupling elements are locked and maintained in position. Further in this fashion, when the opposite rows of teeth are removed from contact with one another, the coupling elements are released for selective pivotal movement relative to the support rods. An axle having a pair of ends is disposed extending through and maintained at the opposite ends thereof by the first ends of the coupling elements and the support rods. The first cam clamp is carried by one end of the axle and is associated with the support rod that is opposite thereto, such that the first cam clamp bears against either one of the support rods or the first end of the said one of the coupling elements with a camming action. In this manner, the opposite rows of teeth on the first end of the one of the coupling elements and the support rods are pushed into contact with one another. Further in this manner, movement of the first cam clamp moves the axle, thereby pushing the opposite rows of teeth on the first end of the other of the coupling members and the support rod into contact with one another. In this fashion, a "double-locking" and "double-releasing" action is provided for simultaneously locking and releasing both of the coupling elements.

In yet another preferred embodiment, the means formed between the second end of one of the coupling elements and the headrest for selectively locking and releasing the headrest at any desired angle relative to the support is seen to include respective opposite circular rows of mating teeth that are formed on the second end of one of the coupling elements and the headrest. In this manner, when the opposite rows of teeth are bought into contact with one another the headrest is locked and maintained in position. Further in this manner, when the opposite rows of teeth are removed from contact with one another, the headrest is released for selective pivotal movement of the headrest relative to the coupling elements. The second cam clamp is carried by and associated with the second end of the one of the coupling elements and the headrest opposite thereto, such that the second cam clamp bears against either the headrest or the second end of the coupling element with a camming action. In this manner, the opposite rows of teeth are pushed into contact with one another, whereby a locking and releasing action is provided for locking and releasing the headrest, so that the headrest may be vertically pivoted about the second ends of the coupling elements, so that the angle of the headrest frame relative to the coupling elements may be selectively adjusted.

These and further objects and advantages of the present invention will become readily apparent from a reading of the following specification when taken in conjunction with the drawings enclosed herewith.

BRIEF DESCRIPTION OF THE DRAWINGS

FIG. 11A the headrest in use supporting the head of a user at a given angle.

FIG. 11B shows a user moving the second cam clamp into the releasing position thereof with only one hand while simultaneously selectively adjusting the angle at which the headrest will support the user with the other hand.

FIG. 11C shows the adjusted headrest in use now supporting the head of the user at the angle chosen in FIG. 11A.

DESCRIPTION OF PREFERRED EMBODIMENTS

Figure 1:
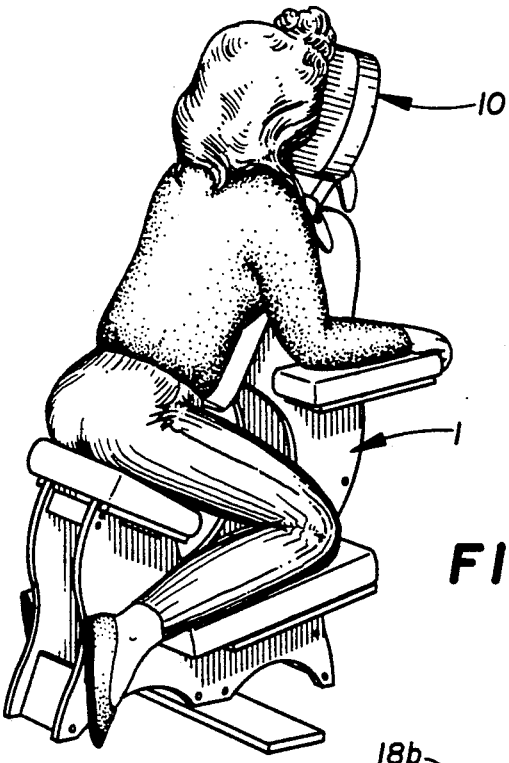
FIG. 1 is a perspective view of the headrest of the present invention attached to an examining chair in use to support the face of a user thereof.

Referring now to the drawings, the adjustable headrest 10 of the present invention is now discussed with reference to an examination chair 1, such as may be utilized by an orthopedic surgeon when conducting an examination. It is to be noted that, consonant with the teachings of the present invention, the headrest 10 to be now described may be attached to any other suitable desired support 10, such as the therapeutic table seen in FIG. 12.

With particular reference now to FIG. 1, the headrest 10 is joined to the support 1 by the use of a pair of substantially parallel support rods 11. Joined thusly, the support rods 11 may extend from the support 1 either horizontally, vertically or at any other desired angle or orientation. Each of the support rods 11 has a respective first end that is secured to or otherwise carried by the support 1. Each of the support rods 11 further has a second, opposite end that is remote from the first end thereof.

Pivotally connected to and carried by each of the pair support rods 11, at substantially the second ends thereof, are respective first ends of a pair of pivotal coupling elements 12. Each of the coupling elements 12 also has a respective second, opposite end that is remote from the first end thereof.

Pivotally connected to the support rods 11 in the manner described above, each of the coupling elements 12 may vertically pivot (about the first ends thereof) relative to the support rod 11 (and the support 1) to which the elements 12 are connected. In this manner, the angle of the coupling elements 12 with respect to the support rods 11 may be selectively adjusted. As will be discussed below, such adjustment will also selectively adjust the height of the second ends of the coupling elements 12 and the height of the headrest pad 14.

Carried by the second ends of the coupling elements 12, for pivotal movement therewith, is a headrest frame 13. In this fashion, the adjustment of the angle of the coupling elements 12 relative to the support rods 11 concomitantly selectively adjusts the height of the headrest frame 13 (and the angle of the headrest frame 13 with respect to the support rods 11).

Carried by the headrest frame 13 is a headrest pad 14. Carried thusly, the headrest pad 14 moves (pivots) concomitantly with the movement (the pivotal movement) of the headrest frame 13. In this manner, the adjustment of the angle of the coupling elements 12 relative to the support rods 11, as described above, also concomitantly selectively adjusts the height of the headrest pad 14 (and the angle of the headrest pad 14 with respect to the support rods 11).

Figure 2:
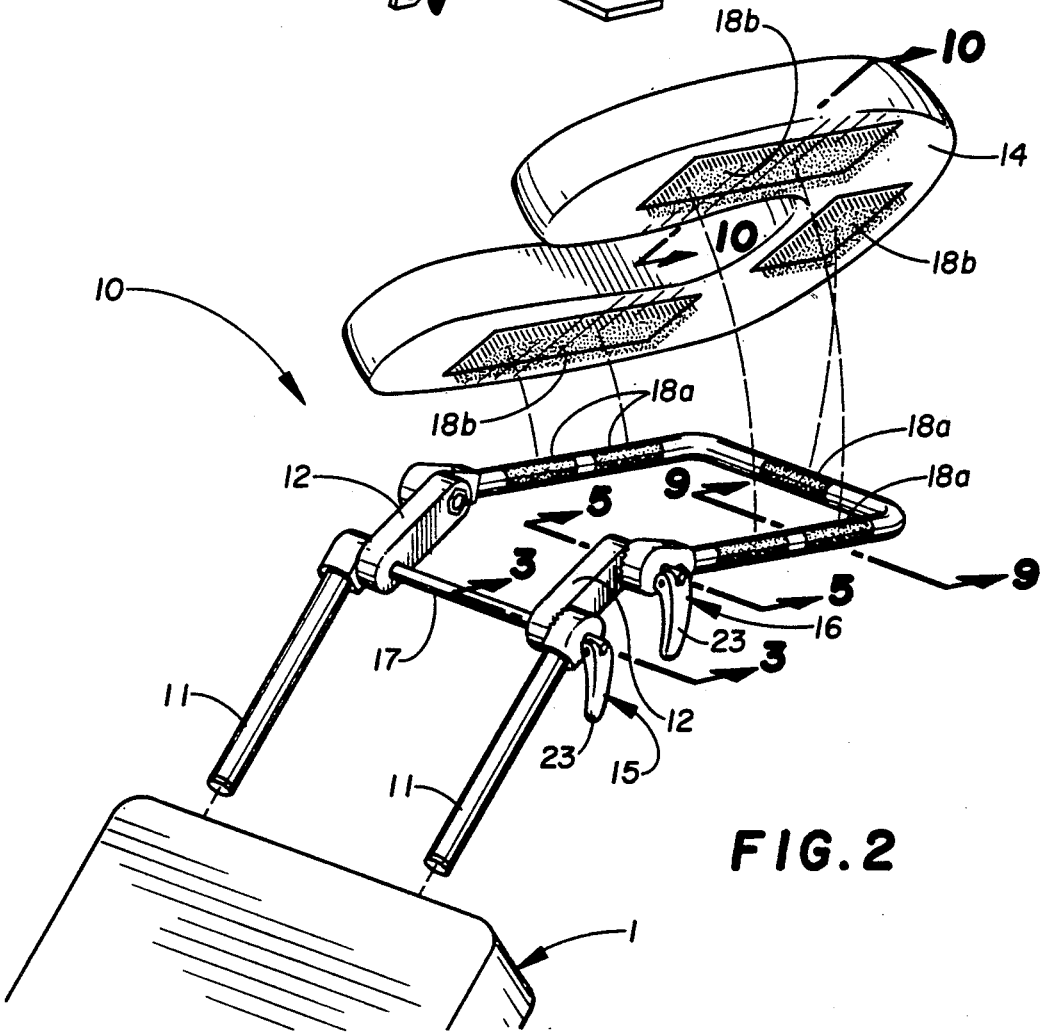
FIG. 2 is a partially exploded perspective view of the headrest of the present invention showing, inter alia, the means by which the headrest is attached to the frame thereof.
Figure 9:
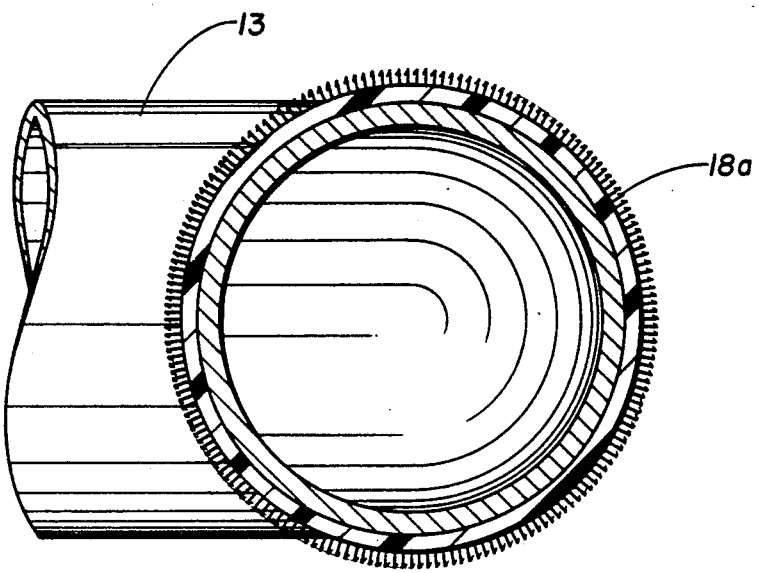
FIG. 9 is a cross-section view taken along lines 9—9 of FIG. 2 of the headrest frame showing the sleeve of hook-and-loop fasteners of the fastening means on the frame for removably securing the headrest pad to the face-rest frame.
Figure 10:
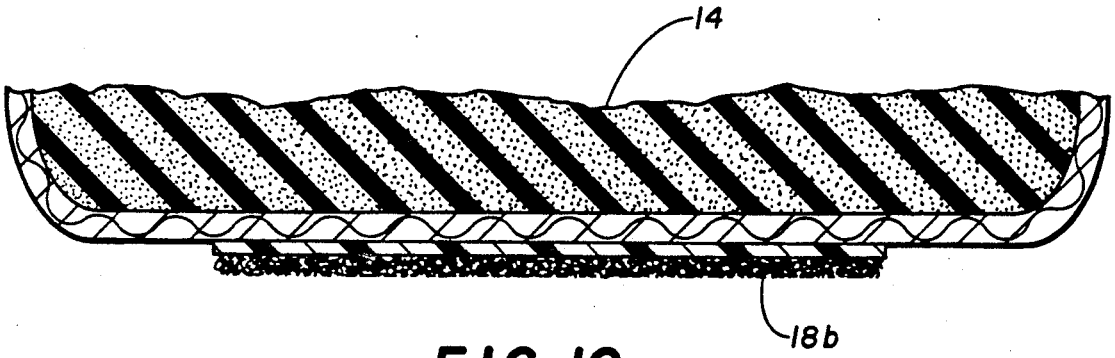
FIG. 10 is a cross-section view taken along lines 10—10 of FIG. 2 of the headrest pad showing the hook-and-loop fasteners of the fastening means on the pad for removably securing the headrest pad to the headrest frame.

Referring in particular to FIGS. 9 and 10, in addition to FIG. 2, the headrest pad 14 is, preferably, removably secured to the headrest frame 13 by a fastening means 18 that is, in turn, carried between the headrest pad 14 and the headrest frame 13. In this manner, the pad 14 is carried by the frame 13 for concomitant movement therewith.

Preferably, the fastening means 18 are mating hook-and-loop fasteners. One of the hook-and-loop fasteners **18*a* is in the form of sleeves that are carried by the headrest frame 13 (FIG. 9). The other of the hook-and-loop fasteners 18*b* is in the form of a pad or strip that is carried by the underside (the bottom) of the headrest pad 14 (FIG. 10). In this manner, the face pad 14 is removably secured to the headrest frame 13**.

Referring now to FIGS. 2–8, height and angle adjustment of the headrest pad 14 is provided by a pair of releasing and locking means 15 and 16. In the case of the means 15, this means is a "double-releasing" and "double-locking" means. Each of the releasing and locking means 15 and/or 16 is associated with a respective coupling element(s) 12. Preferably, the means 15 is associated at the first end of the coupling elements 12 and the means 16 is associated at the second end of the coupling element 12. As is seen in the drawings, it is especially preferred that the mean 15 and 16 be associated with the same coupling element 12.

Referring in particular now to FIGS. 2–4 and 7, the means 15 is provided for selectively "double-releasing" both of the first ends of the coupling elements 12. This permits the coupling elements 12 to be vertically pivoted relative to the support rods 11, so that the height of the second ends of the coupling elements 12 may be selectively adjusted to a height, as desired. The means 15 is further provided for selectively "double-locking" both of the first ends of the coupling elements 12 in place, whereby both of the coupling elements 12 may be locked with the second ends thereof (and the headrest pad 14) maintained at the desired selected height.

Extending between and carried by each of the coupling elements 12 and the support rods 11, preferably at the second ends thereof, is an axle 17. This axle 17 provides additional structural strength and stability to the headrest 10. This axle 17 also forms part of the means (the first locking means) between the first ends of the coupling elements 12 and the support rods 11 for selectively simultaneously releasing and locking each of the coupling elements at any desired angle relative to the support with a single camming action, as shall be discussed at length below.

Referring in particular now to FIGS. 2, 5–6 and 8, the means 16 is provided for selectively releasing the headrest frame 13, whereby the headrest frame 13 may be vertically pivoted about the second ends of the coupling elements 12, for selectively adjusting the angle of the headrest frame 13 relative to the coupling elements 12, as desired. The means 16 is further provided for selectively locking the headrest frame 13 in place on the second ends of the coupling elements 12, whereby the headrest frame 13 (and the headrest pad 14 carried thereby) may be locked and maintained at the selected angle.

As will be discussed at length below, it is preferred that the means 15 and 16 include respectively, first and second quick cam clamps, such that the means 15 and 16 may be locked and unlocked with the use of only one hand.

Having thus described the basic differences between the means 15 and 16, with reference now to FIGS. 2–8, the similar structures of these two means 15 and 16 is now further discussed.

Each of the means 15 and 16 includes respective first circular rows of locking teeth 19*a* and 19*b*, respectively. In the case of the means 15, these teeth 19*a* are formed on and carried by either the support 1 or on the support rods 11. Preferably, two such rows of teeth 19*a* are provided, one being formed on each of the support rods 11. In the case of the means 16, these teeth 19*b* are formed on and carried by the headrest frame 13.

Each of the means 15 and 16 further includes a respective second row of locking teeth 20*a* and 20*b*, respectively. In the case of means 15, these teeth 20*a* are formed on and carried by the first end of the coupling elements 12 opposite of the rows 19*a* formed on the support 1 or support rods 11. Preferably, two such respective rows of teeth 20*a* are provided, one being formed on each of the first ends of the coupling elements 12 opposite of the rows 19*a*. In the case of means 16, these teeth 20*b* are formed on and carried by the second end of one of the coupling elements 12 opposite of the row 19*b* on the headrest frame 13.

Formed in the manner described above, when the opposing first and second rows of locking teeth 19*a* and 20*a*, respectively, of the means 15 are bought into engagement with one another, (both of) the coupling elements 12 are "double-locked" into place. When the opposing rows of teeth 19*a* and 20*a* are removed from such engagement with one another, (both of) the coupling elements 12 are "double-released". Similarly, when the opposing first and second rows of locking teeth 19*b* and 20*b*, respectively, of the means 16 are bought into engagement with one another, the headrest frame 13 and the headrest pad 14 carried thereon are locked into place. And, when the opposing rows of teeth 19*b* and 20*b* are removed from engagement with one another, the headrest frame 13 and the headrest pad carried thereon are released.

Figure 3:
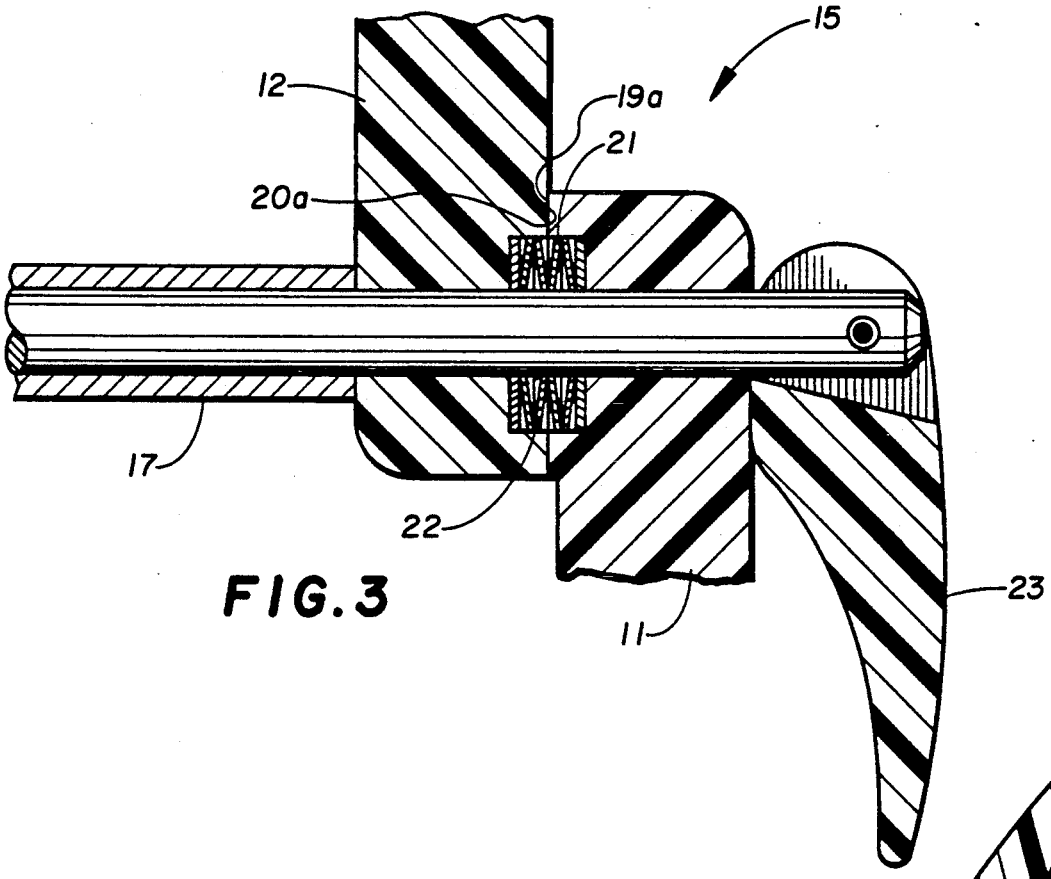
FIG. 3 is a cross-section view taken along lines 3—3 of FIG. 2, of the resilient means and the means for "double-releasing" and "double-locking" the coupling elements, wherein the first quick cam clamp is seen positioned in the locking position thereof.
Figure 4:
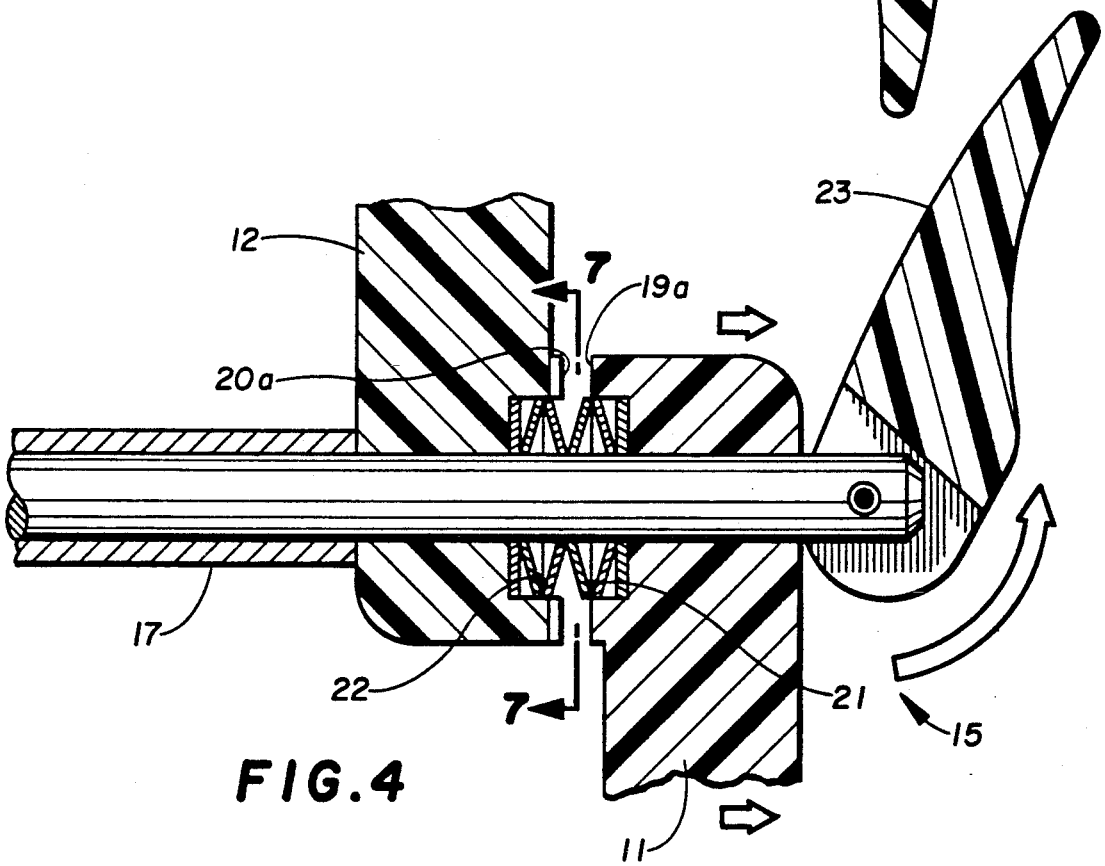
FIG. 4 is a cross-section view substantially corresponding to FIG. 3, but wherein the first quick cam clamp is seen positioned in the releasing position thereof.
Figure 5:
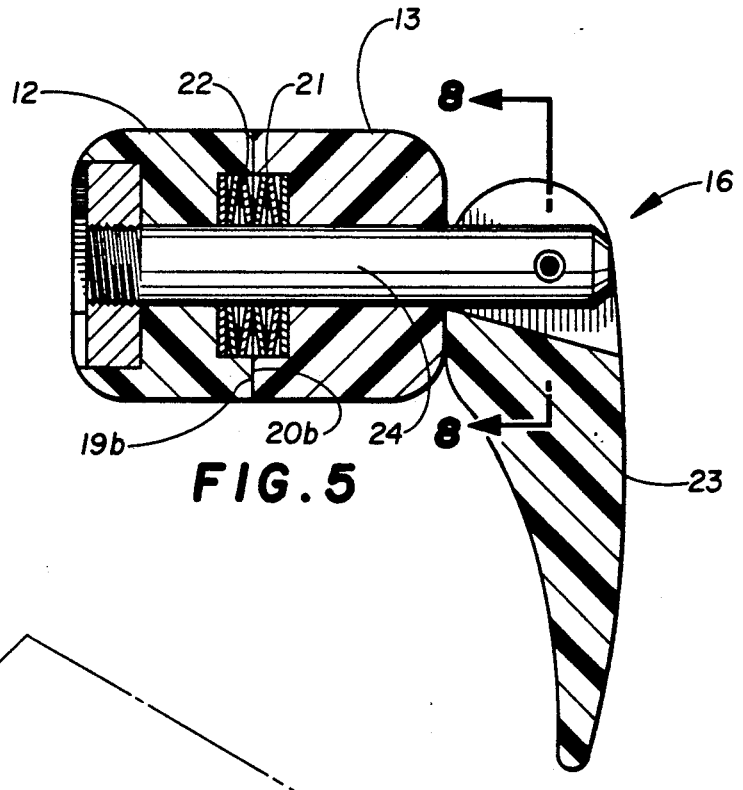
FIG. 5 is a cross-section view taken along lines 5—5 of FIG. 2, of the resilient means and the means for selectively releasing and locking the headrest, wherein the second quick cam clamp is seen positioned in the locking position thereof.
Figure 6:
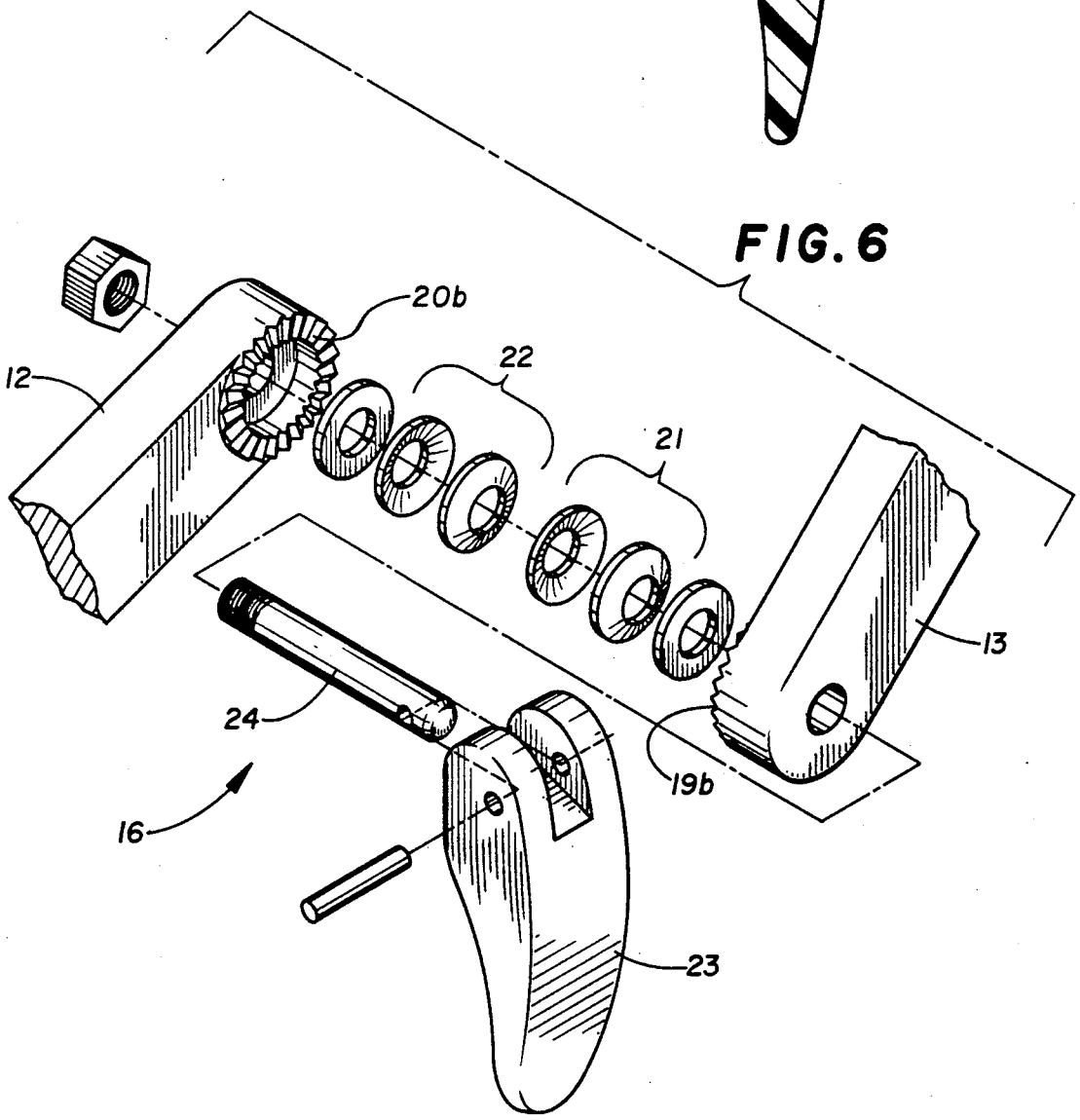
FIG. 6 is an exploded view, in perspective, of the resilient means and means formed between the second end of the coupling member and the headrest for selectively releasing and locking the headrest.
Figure 7:
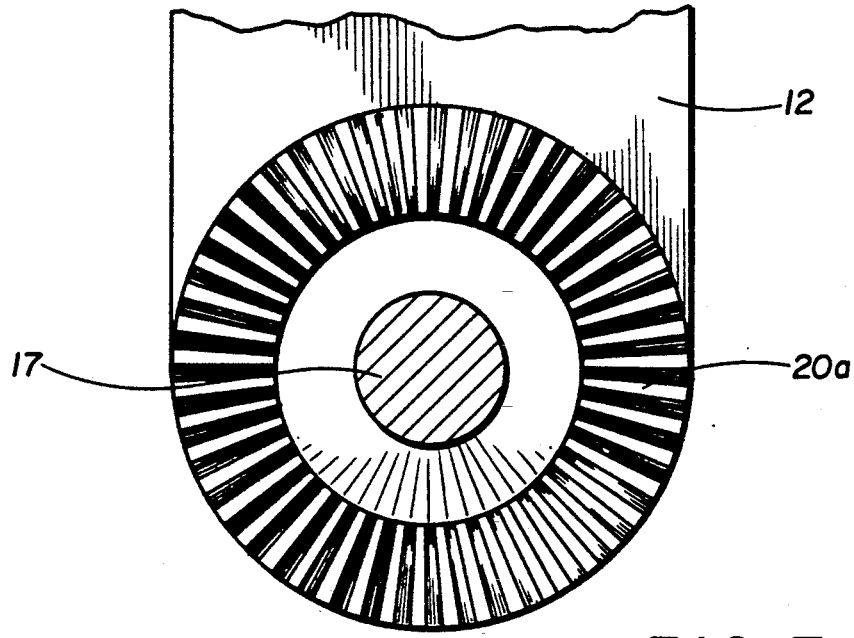
FIG. 7 is a partial section view taken along lines 7—7 of FIG. 4 and showing a circular row of locking teeth.
Figure 8:
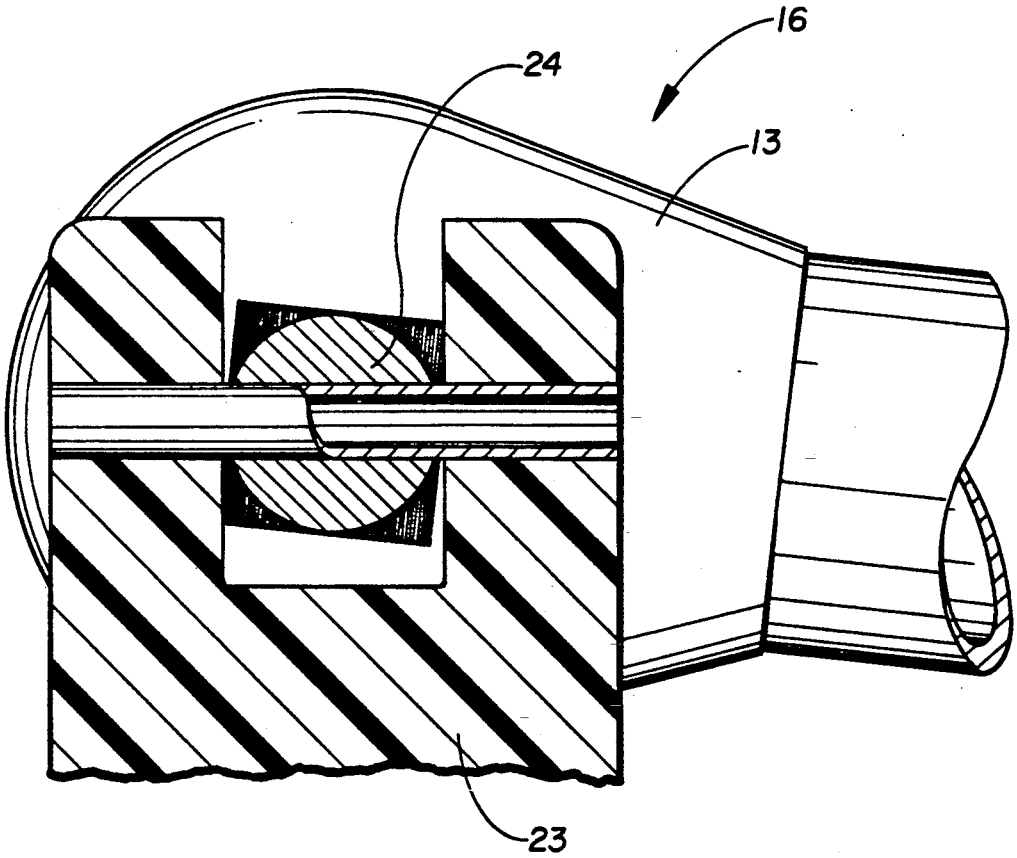
FIG. 8 is a cross-section view taken along lines 8—8 of FIG. 5 showing the lever cam pivot of the second quick cam clamp of the present invention.

With particular reference now to FIG. 6, in addition to FIGS. 3–5, respective resilient means are seen. Each of these respective resilient means are, preferably, in the form of respective pairs of opposed, resiliently-biased, flexible spacers 21 and 22.

In the case of means 15, this resilient means (the first pair of spacers 21 and 22) is disposed between the one of the support rods 11 and the first end of the coupling element 12 that is pivotally connected thereto. Disposed thusly, the spacers 21 and 22 constantly resiliently bias the said support rod 11 and first end of the coupling element 12 away from one another, so that the locking teeth 19*a* and 20*a* are removed from engagement with one another. In this manner, the coupling elements 12 may be vertically pivoted relative to the support rods 11, so that the height of the second ends of the coupling elements 12 may be selectively adjusted.

In the case of means 16, this resilient means (the second pair of spacers 21 and 22) is disposed between the second end of the coupling element 12 and the headrest frame 13 pivotably connected thereto. Disposed thusly, the spacers 21 and 22 constantly resiliently bias the said second end of the coupling element 12 and the headrest frame 13 away from one another, so that the locking teeth 19*b* and 20*b* are removed from engagement with one another. In this manner, the headrest frame 13 may be vertically pivoted relative to the second ends of the coupling elements 12, so that the angle of the headrest frame 13 and the headrest pad 14 carried thereon relative to the second ends of the coupling elements 12 may be selectively adjusted.

Referring in particular now to FIGS. 3–6, the means 15 and 16 each further include, respectively, first and second cam clamps 23 that are movable between respective first releasing positions and second locking positions thereof. In the first releasing positions thereof, the resilient means 21 and 22 are permitted to remove the first and second circular rows of locking teeth 19*a* and *b* and 20*a* and *b*, respectively, from engagement with one another (see FIG. 4). In the second locking positions thereof, the resilient means 21 and 22 of the releasing means are selectively overcome, such that the first and second circular rows of locking teeth 19*a* and *b* and 20*a* and *b*, respectively, removed into engagement with one another (see FIGS. 3 and 5).

It is preferred that each of the respective ca clamps 23 be in the form of quick cam clamps. Such quick cam clamps permits the element 15 or 16 to be locked and unlocked with the use of only one hand while user's other hand adjusts the coupling elements 12 and/or the headrest pad 14.

The cam clamps 23 include a respective eccentrically-mounted rounded head portion. The head portion includes a cam surface. A lever portion extends outwardly from the head portion.

As can be seen in FIGS. 3 and 4, the cam clamp 23 of the means 15 is pivotally secured to and carried by the axle 17. It is noted that this axle 17 is disposed extending through the coupling member 12, the spacers 21 and 22, washers and the second ends of the support members 11. In this fashion, movement of the cam clamp 23 moves the axle 17 which, in turn, moves the teeth 19*a* and 20*a* on both sides of the headrest, thereby simultaneously locking (double-locking) and releasing (double-releasing) both of the first ends o the coupling members.

As can be seen in FIGS. 5 and 6, the cam clamp 23 of the mean 16 is pivotally secured to a separate mounting pin 24 that is provided for this purpose. The mounting pin 24 is also disposed extending through, respectively, the headrest frame 13, the spacers 21 and 22, washers and the coupling element 12 before being threadably mated with and secured to a nut that is provided for this purpose.

When either of the cam clamps 23 are in the locking positions thereof (FIGS. 3 and 5), the cam surface thereof is in contact with a similar cam surface that are formed on the respective ends of the coupling member 12. In this manner, the cam clamp 23 moves the rows of teeth 19*a* and 20*a* or 19*b* and 20*b* into locking engagement with one another, as described above.

When either of the cam clamps 23 is in the releasing position thereof (FIG. 4), the cam surface thereof is not in contact with the cam surface that is formed on the respective end of the coupling member 12. In this manner, the cam clamp 23 permits the resilient means (the spacers 21 and/or 22) to move the rows of teeth 19*a* and 20*a* or 19*b* and 20*b* out of locking engagement with one another, as described above.

Movement of the cam clamps 23 between their locking and releasing positions is provided by the user thereof pushing on the lever portion, or otherwise, so that the head portion is eccentrically rotated, so as to either bring the cam surface formed on the head portion into or out of contact with the respective cam surfaces formed on the coupling member 12.

Figure 11A:
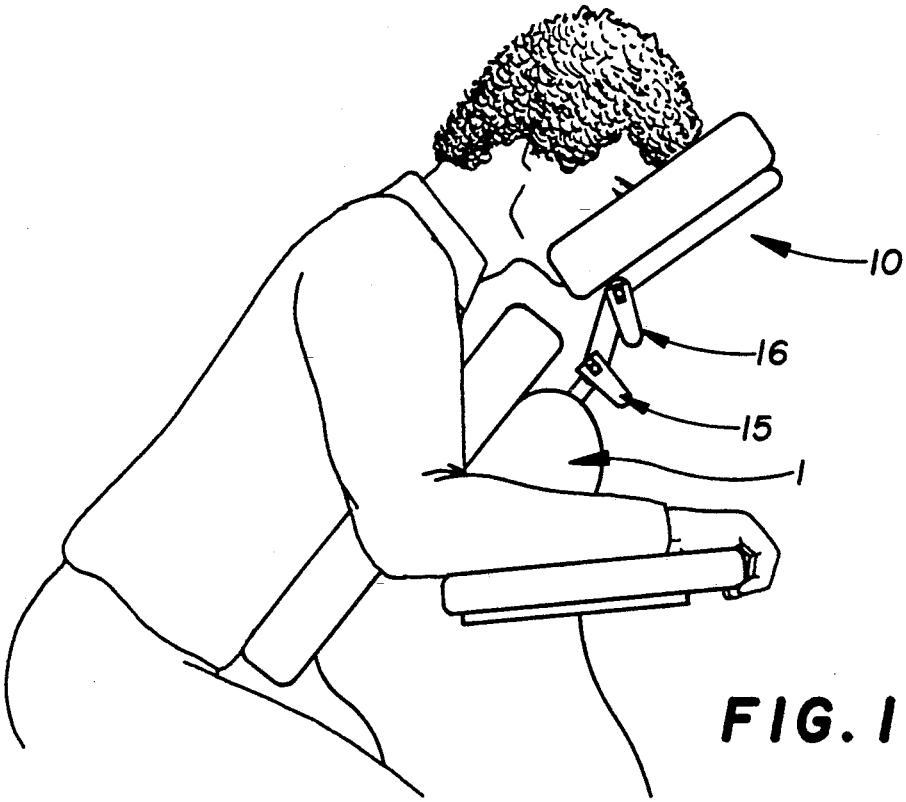
FIGS. 11A–11C are sequential views showing adjustments being made to the angle of the headrest pad.
Figure 11B:
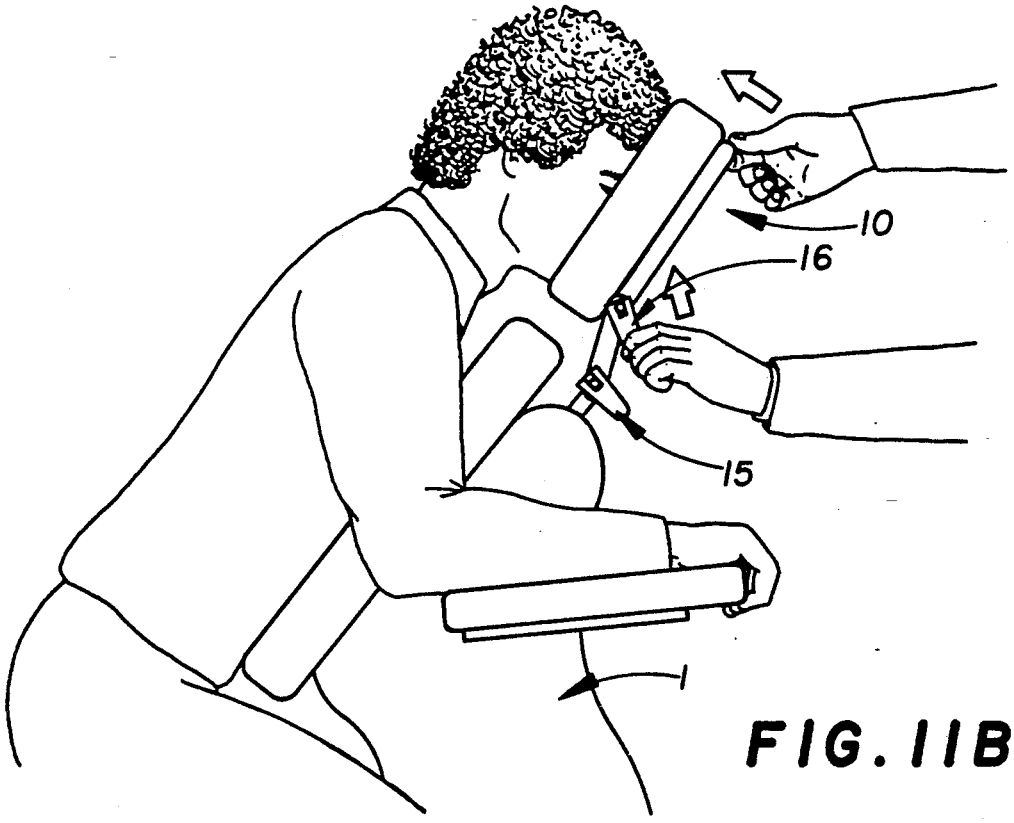
Figure 11C:
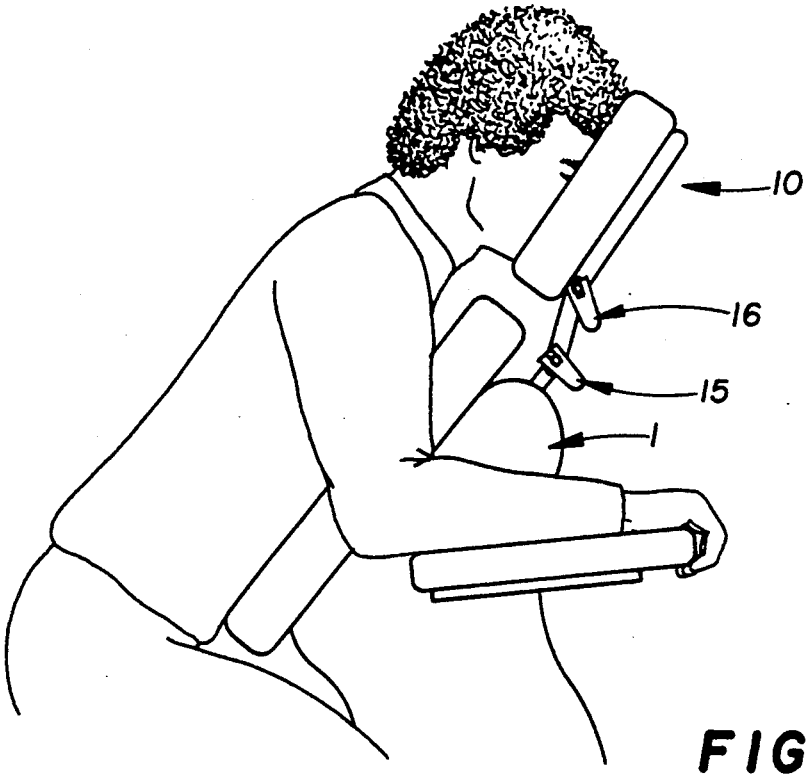

Having thus described the structure of the headrest of the present invention, with reference now to FIGS. 11A–11C, the operation of the headrest is now discussed.

It is noted that the headrest 10 of the present invention may be adjusted while in use supporting the face of an individual therein (FIG. 11A). Should it become necessary or desirable to adjust the position of the head of the individual, a user need only use one hand to move the desired cam clamps 23 from the respective locking positions thereof and into the respective releasing positions thereof, wherein the user may accordingly accurately adjust the positioning of the headrest with their other hand (FIG. 11B). Then, the user may use the same one hand to move the desired cam clamps 23 from the respective releasing positions thereof and into the respective locking positions thereof. Once repositioned, the headrest 10 then continues to securely and snugly hold the individual in the selected position (FIG. 11C).

While depicted otherwise, it should be clearly understood that the patient may also be placed in a supine, or face up, position on the table while using the headrest. This is particularly useful for elderly patients with limited movement of the head/neck.

Figure 12:
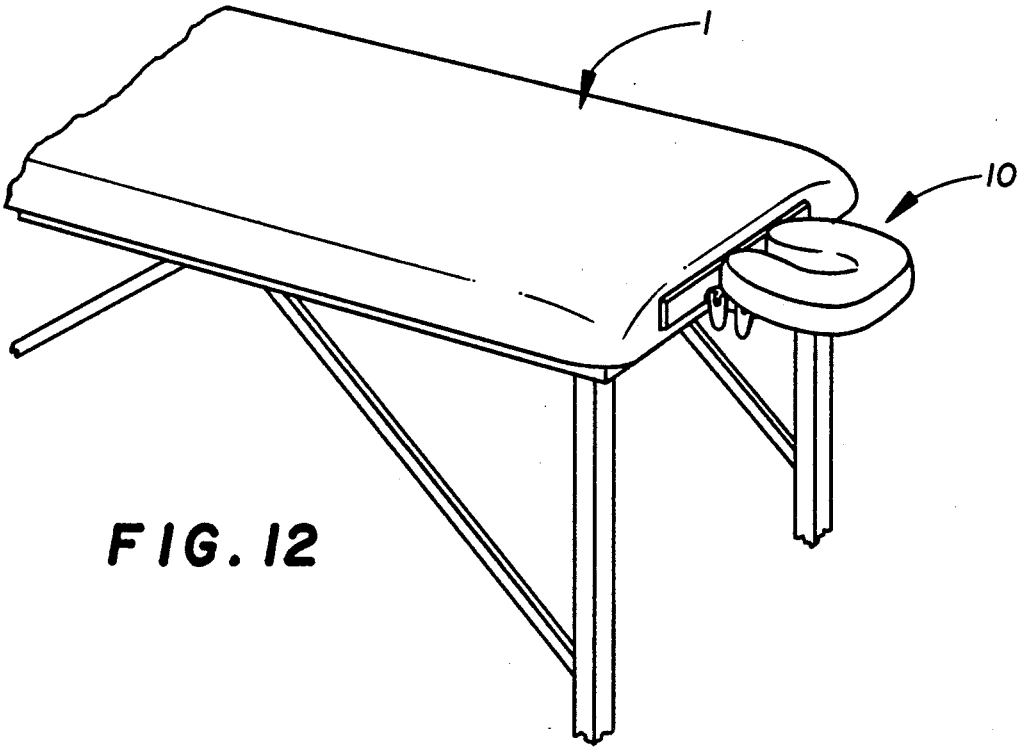
FIG. 12 is a partial perspective view of the headrest of the present invention adapted for use on a therapeutic table.

It is further noted that when the headrest is used in conjunction with a table, such as is seen in FIG. 12, the headrest with the means 15 and 16 of the present invention permits adjustment which changes the angle between the head with respect to the neck and spine. If the joint controlled by the means 15 is adjusted, the angle of the head with respect to the spine is changed. Curvature is produced in the neck and back. If the joint controlled by the means 16 is adjusted, more curvature of the neck is obtained. Thus the therapist can designate the portion of the body/neck at which angular change is produced. Further, this arrangement allows the movement and positioning of the user's head below the level of the support surface.

Obviously, many modifications may be made without departing from the basic spirit of the present invention. Accordingly, it will be appreciated by those skilled in the art, that within the scope of the appended claims, the invention may be practiced other than has been specifically described herein.

What is claimed is:

1. An adjustable headrest for supporting the head of a user thereon, wherein the angles between the user's head with respect to both the user's neck and spine may be selectively adjusted, the headrest comprised of: a headrest having opposite sides for receiving and supporting thereon the user's head at respective selected angles between the user's neck and spine, a support for supporting the user's body thereon, a pair of pivotal coupling elements disposed between and pivotally connected to the support and the head rest, each coupling element having a respective first end being pivotally connected to and carried by the support, so as to vertically pivot about the first ends relative to the support, whereby the angle between the user's head and the user's spine may be selectively adjusted, and each coupling element having a respective second opposite end being pivotally connected to the opposite sides of the headrest, such that the headrest is stably carried thereby for vertical pivotal movement of the headrest about the second ends of the coupling elements, whereby the angle between the user's head and the user's neck may be selectively adjusted, a first cam clamp associated with each of the first ends of one of the coupling elements and the support, such that the first ends of the coupling elements may be selectively double-locked and double-released with a camming action, whereby the headrest may be locked for supporting the head of the user at the selected angle between the user's head and the user's spine, and a second cam clamp associated with at least one of the second ends of one of the coupling elements and the headrest, such that the headrest may be selectively locked with a camming action, whereby the headrest may be locked for supporting the head of the user at the selected angle between the user's head and the user's neck.

2. An adjustable headrest for supporting the head of a user thereon, wherein the angles between the user's head with respect to both the user's neck and spine may be selectively adjusted, the headrest comprised of:

a support for supporting the user's body thereon;

a headrest having opposite sides for receiving and supporting thereon the user's head at respective selected angles between the user's neck and spine;

a pair of pivotal coupling elements disposed between the support and opposite sides of the headrest, each coupling element having a respective first end being pivotally connected to and carried by the support, so as to vertically pivot about the first ends relative to the support;

means including a cam clamp formed between each of the first ends of the coupling elements and the support for selectively double-releasing and double-locking the coupling elements at an desired angle relative to the support with a single camming action, whereby the angle between the user's head and the user's spine may be selectively adjusted and maintained;

each coupling element further having a respective second opposite end being pivotally connected to the opposite sides of the headrest, such that the headrest is stably carried thereby, so that the headrest vertically pivots about the second ends of the coupling elements;

means including a cam clamp formed between at least one of the second ends of the coupling elements and the head rest for selectively releasing and locking the headrest at any desired angle relative to the support with a camming action, whereby the angle between the user's head and the user's neck may be selectively adjusted;

whereby a headrest is provided that is selectively adjustable for positioning the user's head at the desired angle between both the user's spine and neck.

3. The adjustable headrest of claim 2, wherein the means formed between the first ends of the coupling elements and the support for selectively double-releasing and double-locking the coupling elements includes respective circular rows of mating teeth formed on the first ends of each of the coupling elements and the support, so that the rows of teeth on the first ends of the coupling elements are opposite respective rows of teeth that are formed on the support, whereby when the opposite rows of teeth are bought into contact with one another the coupling elements are locked and maintained in position, and further whereby when the opposite rows of teeth are removed from contact with one another, the coupling elements are released for selective pivotal movement relative to the support, an axle having a pair of ends, the axle disposed extending through and maintained at the opposite ends thereof by the first ends of the coupling elements and the support, and a cam clamp carried by one end of the axle and associated with the support opposite the first end of one of the coupling elements, such that the cam clamp bears against either the support or the first end of the said one of the coupling elements with a camming action, thereby pushing the row of teeth on the said first end into contact with the row of teeth on the support that is opposite thereto, and further such that movement of the cam clamp moves the axle, thereby pushing the row of teeth on the first end of the other coupling element into contact with the row of teeth on the support that is opposite thereto, whereby a double-locking and double-releasing action is provided for simultaneously locking and releasing both of the coupling elements.

4. The adjustable headrest of claim 3, further comprising: a resilient means for constantly resiliently biasing the support away from the first ends of the coupling elements pivotably connected thereto, so that both of the opposite rows of locking teeth are simultaneously removed from engagement with one another, whereby both of the coupling elements are double-released, so that both of the coupling elements may be vertically pivoted relative to the support and the height of the second ends of the coupling elements may be selectively adjusted.

5. The adjustable headrest of claim 4, wherein the resilient means includes a pair of opposed flexible spacers disposed between the support and at least one of the first ends of the coupling elements that is pivotally connected thereto.

6. The adjustable headrest of claim 4, wherein the resilient means is disposed such that when the cam clamp is moved to permit the opposite rows of locking teeth to disengage from one another, the resilient means simultaneously urges both of the opposite rows of locking teeth out of engagement with one another, and further such that when the cam clamp is moved to permit the opposite rows of locking teeth to engage one another, the resilient means is selectively overcome and the opposite rows of the locking teeth are simultaneously moved into engagement with one another.

7. The adjustable headrest of claim 2, wherein the means formed between the second end of the coupling element and the headrest includes respective circular rows of mating teeth formed on the second end of the coupling element and the headrest, so that the rows of teeth on the second end of the coupling element are opposite the respective rows of teeth that are formed on the headrest, whereby when the opposite rows of teeth are bought into contact with one another the headrest is locked and maintained in position, and further whereby when the opposite rows of teeth are removed from contact with one another, the headrest is released for selective pivotal movement relative to the support, and a cam clamp carried by and associated with the second end of the coupling element and headrest opposite thereto, such that the cam clamp bears against either the headrest or the second end of the said coupling element with a camming action, thereby pushing the row of teeth on the said second end into contact with the row of teeth on the head rest that is opposite thereto, whereby a locking and releasing action is provided for locking and releasing the headrest.

8. An adjustable headrest for supporting the head of a user thereon, the headrest being comprised of:

a pair of parallel support rods carried by a support, so as to extend outwardly therefrom;

a pair of pivotal coupling elements, each of said coupling elements having a respective first end being pivotally connected to and carried by one of the respective support rods, so as to vertically pivot about the support rod on which said element is carried, whereby the angle of the coupling elements with respect to the support rods may be selectively adjusted;

means formed between the first ends of the coupling elements and the support rods for selectively double-releasing and double-locking the coupling elements at any desired angle relative to the support rods, whereby the angle between the user's head and the user's spine may be selectively adjusted and maintained;

a first cam clamp, the first cam clamp being associated with the first end of the coupling elements and the support rods for selectively unlocking and double-releasing the coupling elements, so that the angle of the coupling elements relative to the support rods may be selectively adjusted, and for selectively double-locking the coupling elements at the angle selected, so that the selected angle of the coupling elements relative to the support rods may be maintained;

each coupling element further having a respective second opposite end being pivotally connected to the headrest, such that the headrest is stably carried thereby, so that the headrest vertically pivots about the second ends of the coupling elements;

the headrest including a headrest frame having opposite sides that are carried by the second ends of the coupling elements for pivotal movement therewith, whereby the adjustment of the angle of the coupling elements relative to the support rods concomitantly selectively adjusts the angle of the headrest frame with respect to the support rods;

a headrest pad for receiving and supporting thereon the user's head at respective selected angles between the user's neck and spine, the headrest pad being carried by the headrest frame for pivotal movement therewith, whereby the adjustment of the angle of the coupling elements relative to the support rods concomitantly selectively adjusts the angle of the headrest pad with respect to the support rods;

means formed between at least one of the second ends of the coupling elements and the headrest frame for selectively releasing and locking the headrest frame and the headrest pad carried thereon at any desired angle relative to the support, whereby the angle between the user's head and the user's neck may be selectively adjusted;

a second cam clamp, the second cam clamp being associated with the second end of one of the respective coupling elements and the headrest frame for selectively unlocking the headrest frame, so that the angle of the headrest frame and the headrest pad carried thereon relative to the second ends of the coupling elements may be selectively adjusted and locking the headrest frame at the angle selected, so that the selected angle of the headrest frame and the headrest pad carried thereby relative to the coupling elements may be maintained;

such that either cam clamp may be operated with the use of only one hand while the other hand holds and moves the headrest pad for selectively adjusting angle of the headrest pad with respect to the support;

whereby a headrest is provided that is selectively adjustable for positioning the user's head at the desired angle between both the user's spine and neck.

9. The adjustable headrest of claim 8, wherein the parallel support rods extend horizontally from the support by which they are carried.

10. The adjustable headrest of claim 8, wherein the means formed between the first ends of the coupling elements and the support rods for selectively double-releasing and double-locking the coupling elements includes respective circular rows of mating teeth formed on the first ends of each of the coupling elements and the support rods, so that the rows of teeth on the first ends of the coupling elements ar opposite respective rows of teeth that are formed on the support rods, whereby when the opposite rows of teeth are bought into contact with one another, the coupling elements are locked and maintained in position, and further whereby when the opposite rows of teeth are removed from contact with one another, the coupling elements are released for selective pivotal movement relative to the support rods, an axle having a pair of ends, the axle disposed extending through and maintained at the opposite ends thereof by the first ends of the coupling elements and the support rods, and the first cam clamp being carried by one end of the axle and associated with the support rod opposite to the first end of one of the coupling elements, such that the first cam clamp bears against either one of the support rods or against the first end of the said one of the coupling elements with a camming action, thereby pushing the row of teeth on the said first end into contact with the row of teeth on the support rod that is opposite thereto, and further such that movement of the first cam clamp moves the axle, thereby pushing the row of teeth on the first end of the other coupling element into contact with the row of teeth on the support rod that is opposite thereto, whereby a double-locking and "double-releasing" action is provided for simultaneously locking and releasing both of the coupling elements.

11. The adjustable headrest of claim 10, further comprising: a resilient means for constantly resiliently biasing the support rods away from the first ends of the coupling elements pivotably connected thereto, so that both of the opposite rows of locking teeth are simultaneously removed from engagement with one another, whereby both of the coupling elements are double-released, so that both of the coupling elements may be vertically pivoted relative to the support rods and the height of the second ends of the coupling elements may be selectively adjusted.

12. The adjustable headrest of claim 11, wherein the resilient means includes a pair of opposed flexible spacers disposed between the support rods and at least one of the first ends of the coupling elements that is pivotally connected thereto.

13. The adjustable headrest of claim 11, wherein the resilient means is disposed such that when the first cam clamp is moved to permit the opposite rows of locking teeth to disengage from one another, the resilient means simultaneously urges both of the opposite rows of locking teeth out of engagement with one another, and further such that when the first cam clamp is moved to permit the opposite rows of locking teeth to engage one another, the resilient means is selectively overcome and the opposite rows of the locking teeth are simultaneously moved into engagement with one another.

14. The adjustable headrest of claim 8, wherein the means formed between the second end of the coupling element and the headrest frame includes respective circular rows of mating teeth formed on the second end of the coupling element and the headrest frame, so that the rows of teeth on the second end of the coupling element are opposite the respective rows of teeth that are formed on the headrest frame, whereby when the opposite rows of teeth are bought into contact with one another, the headrest frame and the headrest pad carried thereon is locked and maintained in position, and further whereby when the opposite rows of teeth are removed from contact with one another, the headrest frame and the headrest pad carried thereon is released for selective pivotal movement relative to the coupling elements, and the second cam clamp carried by and associated with the second end of one of the coupling elements and headrest opposite thereto, such that the second cam clamp bears against either the headrest or the second end of the said coupling element with a camming action, thereby pushing the row of teeth on the said second end into contact with the row of teeth on the head rest that is opposite thereto, whereby a locking and releasing action is provided for locking and releasing the headrest.

15. The adjustable headrest of claim 8, further comprising fastening means carried between the headrest pad and the headrest frame, whereby the headrest pad is carried by the headrest frame for concomitant movement therewith.

16. The adjustable headrest of claim 15, wherein the fastening means is comprised of hook-and-loop fasteners, one of the hook-and-loop fasteners being carried by the headrest frame and the other of the hook-and-loop fasteners being carried by the headrest pad, whereby the headrest pad is removably secured to the headrest frame.

* * * * *